US005797220A

United States Patent [19]

Zaccagni

[11] Patent Number: 5,797,220

[45] Date of Patent: *Aug. 25, 1998

[54] FASCIA-SOFFIT COMBINATION

[75] Inventor: Richard J. Zaccagni, Downers Grove, Ill.

[73] Assignee: ZMC, Inc., Addison, Ill.

[ * ] Notice: The term of this patent shall not extend beyond the expiration date of Pat. No. 5,537,785.

[21] Appl. No.: 794,893

[22] Filed: Feb. 5, 1997

Related U.S. Application Data

[60] Division of Ser. No. 633,478, Apr. 17, 1996, which is a continuation-in-part of Ser. No. 304,277, Sep. 12, 1994, Pat. No. 5,537,785, which is a continuation-in-part of Ser. No. 238,657, May 5, 1994, abandoned.

[51] Int. Cl.[6] ..... E04D 13/064

[52] U.S. Cl. ..... 52/11; 52/94

[58] Field of Search ..... 52/11, 94, 95; 248/48.1, 48.2

[56] References Cited

U.S. PATENT DOCUMENTS

| | | | |
|---|---|---|---|
| 688,595 | 12/1901 | Coe . | |
| 846,238 | 3/1907 | O'Dowd . | |
| 2,843,063 | 7/1958 | Thomson . | |
| 2,890,664 | 6/1959 | Rachlin . | |
| 3,550,381 | 12/1970 | South | 52/11 X |
| 3,612,453 | 10/1971 | Zimmer . | |
| 3,744,203 | 7/1973 | Sablom, Jr. . | |
| 3,864,882 | 2/1975 | Lasscock . | |
| 3,874,131 | 4/1975 | Webster . | |
| 3,913,284 | 10/1975 | Hall | 52/11 |
| 3,939,616 | 2/1976 | Schapker . | |
| 4,092,808 | 6/1978 | Maloney, Jr. et al. . | |
| 4,195,452 | 1/1980 | Smith et al. . | |
| 4,461,128 | 7/1984 | Knoebl . | |
| 4,580,374 | 4/1986 | Quinnell | 52/95 |
| 4,848,043 | 7/1989 | Nichols et al. . | |
| 5,537,785 | 7/1996 | Zaccagni . | |

FOREIGN PATENT DOCUMENTS

| | | | |
|---|---|---|---|
| 1270110 | 6/1990 | Canada . | |
| 2678013 | 12/1992 | France . | |
| 2726607 | 12/1978 | Germany . | |
| 2735975 | 2/1979 | Germany . | |
| 93934 | 3/1959 | Norway . | |
| 848635 | 9/1960 | United Kingdom | 52/11 |
| 1143421 | 2/1969 | United Kingdom | 52/11 |
| 1469769 | 4/1978 | United Kingdom . | |
| 2239274 | 6/1991 | United Kingdom . | |

*Primary Examiner*—Creighton Smith
*Attorney, Agent, or Firm*—Rockey, Milnamow & Katz, Ltd.

[57] ABSTRACT

A fascia member and a soffit member are useful for trimming a building structure. The fascia member has a generally vertical panel and a generally horizontal flange projecting from the generally vertical panel at a lower corner. The generally horizontal flange has a locking lip extending along a distal edge. The soffit member has an edge portion having a plurality of spaced locking lips adapt to be engaged with the locking lip extending therealong. A channel member extending along the generally horizontal flange is employed for confining the edge portion of the soffit member within the channel member, when the locking lips of the edge portion of the soffit member are engaged with the locking lip extending therealong, so as to interlock fascia member mid the soffit member. The fascia member and the channel member may be a single piece or two separate pieces. In either instance, the channel member has an upper wall, an inner, vertical wall, and an upper wall. The soffit member has reinforcing ribs adapted to bear against the upper wall of the channel member.

5 Claims, 4 Drawing Sheets

FASCIA-SOFFIT COMBINATION

CROSS-REFERENCE TO RELATED APPLICATIONS

This application is a division of U.S. patent application Ser. No. 08/633,478, which was filed on Apr. 17, 1996. U.S. patent application Ser. No. 08/633,478, is a continuation-in-part of U.S. patent application Ser. No. 08/304,277, which was filed on Sep. 12, 1994, and the disclosure of which is incorporated herein by reference, now U.S. Pat. No. 5,537,785. U.S. patent application Ser. No. 08/304,277, is a continuation-in-part of U.S. patent application Ser. No. 08/238,657, which was filed on May 5, 1994, now abandoned.

TECHNICAL FIELD OF THE INVENTION

This invention pertains to a fascia member and a soffit member in a novel combination for trimming a building structure. The fascia member and the soffit member may be roll-formed from sheet metal, such as sheet aluminum, and are interlocked in a novel manner.

BACKGROUND OF THE INVENTION

A known combination in widespread use for trimming a building structure comprises a fascia member, a soffit member, and separate channel member, which are three separate pieces roll-formed from sheet metal, such as sheet aluminum. The fascia member is formed with a lower flange, on which the channel member rests and to which the channel member is secured adhesively. An edge portion of the soffit member fits into the channel member, between an upper wall of the channel member and a lower wall of the channel member, as far as an inner wall of the channel member. The soffit member has reinforcing ribs, which fit between the upper and lower walls of the channel member.

This invention improves the known combination described above by incorporating features disclosed in U.S. patent applications Ser. No. 08/238,657 and Ser. No. 08/304,277, supra. Moreover, in the exemplary embodiments illustrated in the drawings and described below, there is no need for the channel member to be adhesively secured.

SUMMARY OF THE INVENTION

This invention provides a novel combination comprising a fascia member and a soffit member for trimming a building structure. The fascia member and the soffit member are interlocked in a novel manner.

Being elongate, the fascia member has a generally vertical panel and a generally horizontal flange projecting from the generally vertical panel at a lower corner, which is defined by a lower edge of the generally vertical panel and by a proximal edge of the generally horizontal flange. Having a distal edge, the generally horizontal flange has a locking lip extending along the distal edge. Being elongate, the soffit member has an edge portion having a locking lip engagable with the locking lip extending along the distal edge of the generally horizontal flange.

Preferably, the combination further comprises means defining a channel member extending along the generally horizontal flange of the fascia member for confining the edge portion of the soffit member within the channel member, when the locking lip of the edge portion of the soffit member is engaged with the locking lip extending therealong, so as to interlock the fascia member and the soffit member.

In one contemplated embodiment, in which there is no need for the channel member to be adhesively secured, the fascia member and the channel member are a single piece. Preferably, the channel member has a lower wall projecting toward the generally vertical panel of the fascia member from the locking lip extending along the distal edge of the generally horizontal flange, an inner wall projecting upwardly from the lower wall of the channel member, and an upper wall projecting from the inner wall of the channel member, away from the generally vertical panel of the fascia member, in a generally horizontal direction.

In another contemplated embodiment, in which there is no need for the channel member to be adhesively secured, the fascia member and the channel member are two separate pieces. Preferably, the locking lip extending along the generally horizontal flange has a hooked portion, which hooks toward the generally vertical panel of the fascia member and which terminates at an edge, and the channel member has a lower wall resting on the generally horizontal flange and having a distal edge portion fittable under the edge terminating the hooked portion of the locking lip extending therealong, an inner wall projecting upwardly from the lower wall of the channel member, and an upper wall projecting from the inner wall of the channel member, away from the generally vertical panel, in a generally horizontal direction.

In either contemplated embodiment, the soffit may have reinforcing ribs, which are adapted to bear against the upper wall of the channel member when the locking lip of the edge portion of the soffit member is engaged with the locking lip extending along the distal edge of the generally horizontal flange. Moreover, in either contemplated embodiment, the edge portion of the soffit member may have a plurality of such locking lips spaced from one another and engagable with the locking lip extending along the distal edge of the generally horizontal flange.

In the embodiment wherein the fascia member and the channel member are two separate pieces, the generally vertical panel of the fascia member may have a recess, which is located above the generally horizontal flange of the fascia member and which is adapted to receive the inner wall of the channel member and near portions of the upper and lower walls of the channel member when the distal edge portion of the lower wall of the channel member is fitted under the edge terminating the hooked portion of the locking lip extending along the distal edge of the generally horizontal flange. The recess may be defined by a horizontally extending step formed on the generally vertical panel of the fascia member or by a horizonally extending rib formed thereon.

Herein, directional terms ( e.g., "vertical", "horizontal", "upper", and "lower") are used to refer to features of the novel combination in its installed orientation.

These and other objects, features, and advantages of this invention are evident from the following description of several contemplated embodiments of this invention with reference to the accompanying drawings.

DETAILED DESCRIPTION OF THE ILLUSTRATED EMBODIMENTS

Figure 1:
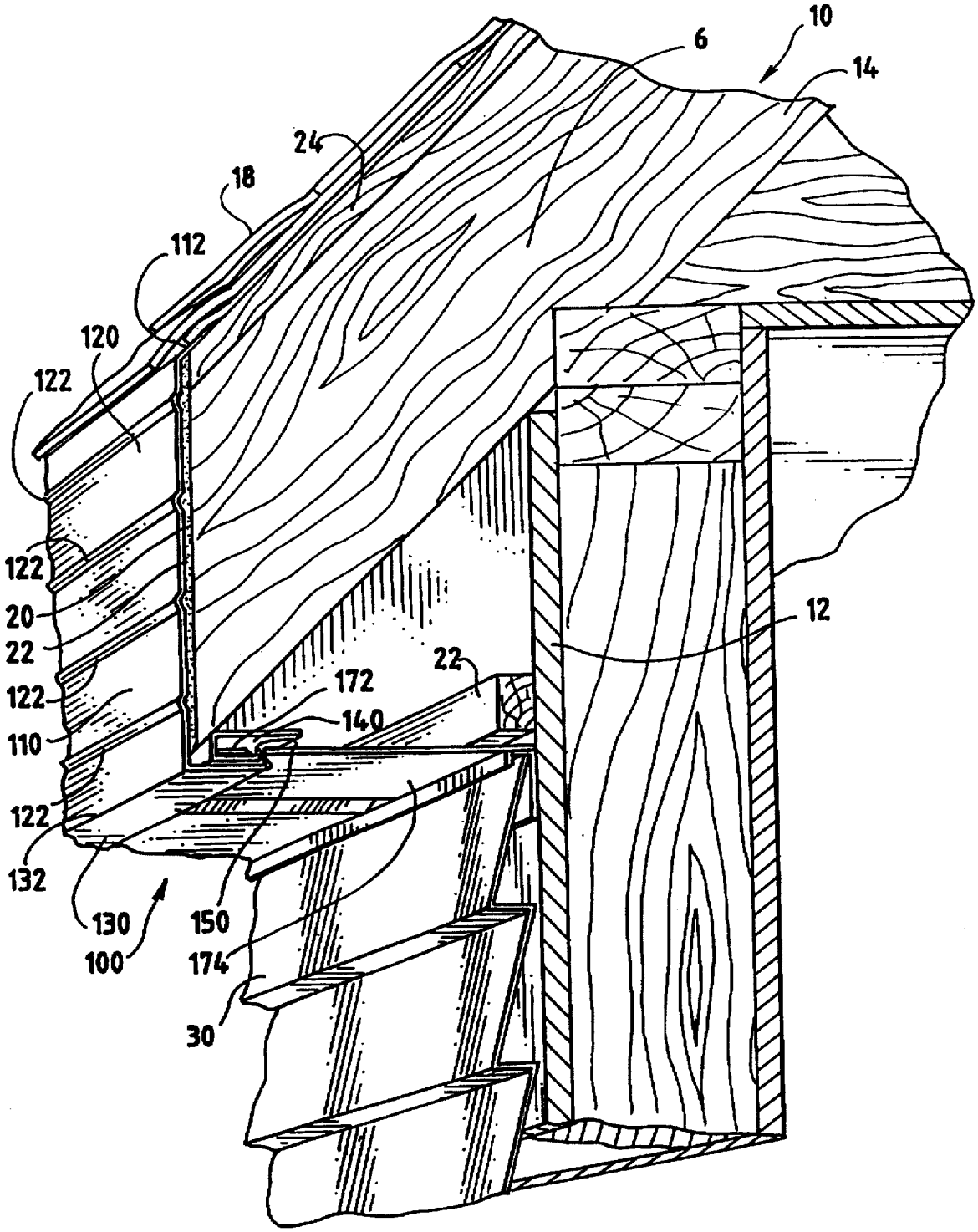
FIG. 1 is a fragmentary, perspective view of a building structure, which is trimmed by a novel combination comprising a fascia member, a channel member, and a soffit member, and according to one contemplated embodiment, in which the fascia member and the channel member are a single piece.

As shown in FIG. 1, a building structure 10 is trimmed by a novel combination 100 comprising a fascia member 110, a channel member 140, and a soffit member 170 and according to one contemplated embodiment of this invention. The fascia member 110 and the channel member 140 are a single piece, which is elongate, which is roll-formed from sheet metal, such as sheet aluminum, and which may be pre-painted. The soffit member 170 is a separate piece, which is elongate, which also is roll-formed from sheet metal, such as sheet aluminum, and which also may be pre-painted.

Generally, the building structure 10 comprises a wooden wall 12 and wooden rafters 14 (one shown) terminating in rafter tails 16 and supporting a shingled roof 18. Each rafter tail 16 has an outer, vertical edge 20, to which the fascia member 110 is secured by an adhesive bead 22. An upper edge portion 112 of the fascia member 110 is bent over a wooden board 24 covering the rafter tails 16 and underlying the shingled roof 18 and is nailed to the wooden board 24. Alternatively, the upper edge portion 112 may be differently shaped, as required by a given installation. At a front edge portion 172 of the soffit member 170, the fascia member 110 and the soffit member 170 are interlocked in a novel manner, as described below. At a back edge portion 174 of the soffit member 170, the soffit member 170 is fastened by nails or other fasteners (not shown) to a wooden mounting cleat 22, which is fastened suitably to the exterior wall 12. Siding panels 30, which also may be roll-formed from sheet metal, such as sheet aluminum, and which also may be pre-painted, are applied to the wooden wall 12, in a conventional manner, below the soffit member 170.

Figure 2:
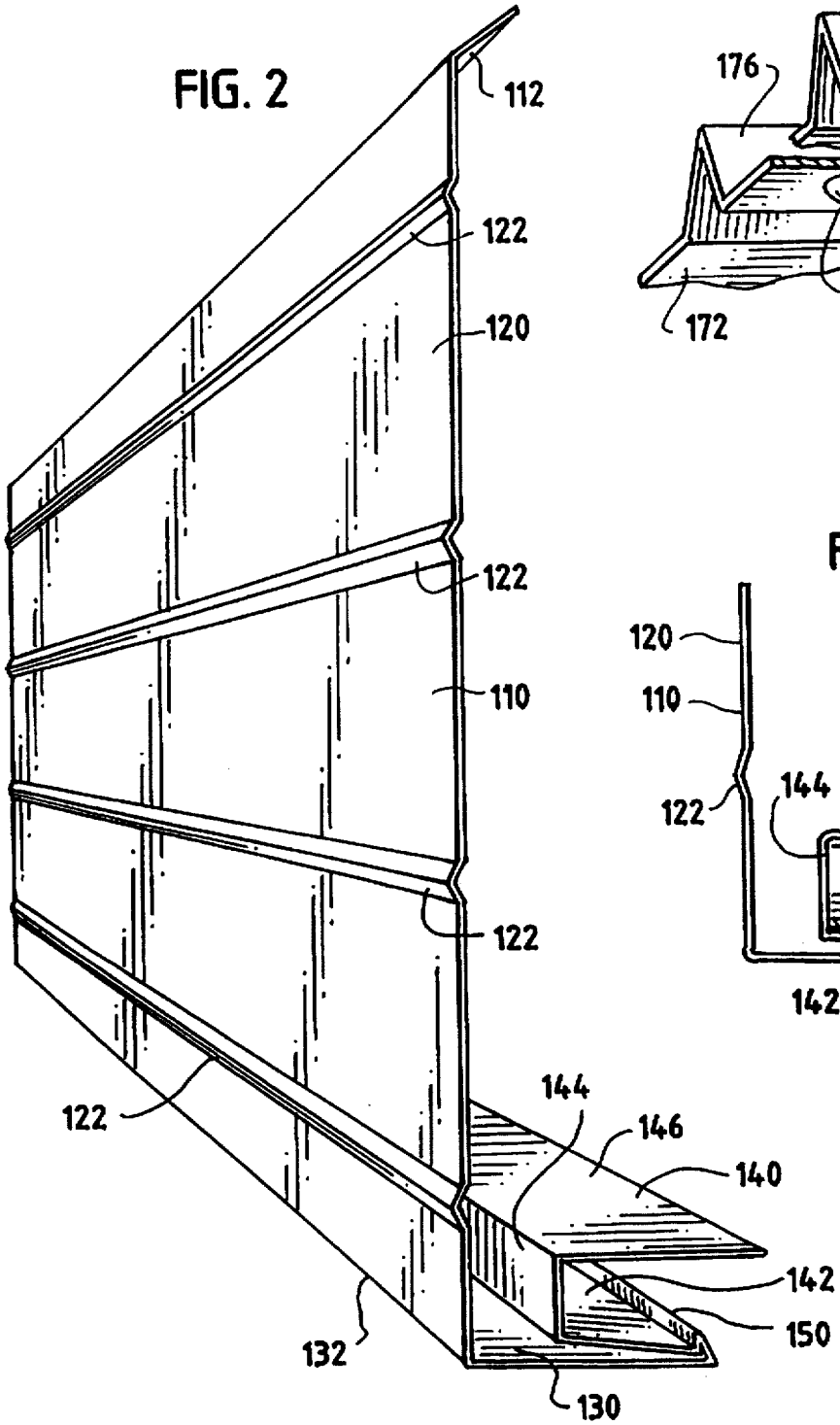
FIG. 2 is a perspective view of the single piece providing the fascia member and the channel member, apart from the soffit member and apart from the building structure.
Figure 3:
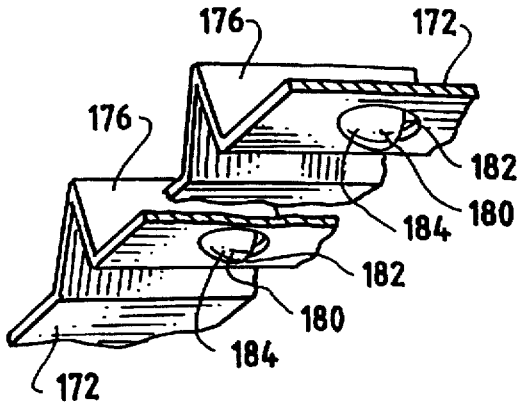
FIG. 3 is a fragmentary, perspective detail of the soffit member, apart from the single piece providing the fascia member and the channel member and apart from the building structure.

As shown in FIG. 2, the single piece providing the fascia member 110 and the channel member 140 is roll-formed so that the fascia member 110 has a generally vertical panel 120, which has spaced reinforcing ribs 122 extending horizontally and projecting outwardly, and so that the fascia member 110 has a generally horizontal flange 130 projecting from the generally vertical panel 120 at a lower corner 132, which is defined by a lower edge of the generally vertical panel and by a proximal edge of the generally horizontal flange 130. Moreover, the single piece providing the fascia member 110 and the channel member 140 is roll-formed so that the fascia member 110 has a locking lip 150, which extends along a distal edge of the generally horizontal flange 140, and so that the channel member 140 has a lower wall 142, an inner wall 144, and an upper wall 146. The lower wall 142 projects toward the generally vertical panel 120, from the locking lip 150, at a small angle (e.g., approximately 10°, as shown) relative to the generally horizontal flange 140. The inner wall 144 projects upwardly from the lower wall 142, in a generally vertical direction. The upper wall 146 projects from the inner wall 144, away from the generally vertical panel 120, in a generally horizontal direction.

The soffit member 170 is roll-formed so as to be substantially planar and so as to have a series of reinforcing ribs 176, which extend transversely across the soffit member 170 and which are spaced longitudinally from one another along the soffit member 170. The front edge portion 172 of the soffit member 170 is formed with a series of locking lips 180, which are similar to one another and which are spaced longitudinally from one another along the soffit member 170. Preferably, each locking lip 180 is formed by piercing and deforming the front edge portion 172 by means of a suitable tool, so as to provide such locking lip 180 with a curved edge 182 facing backwardly and with a camming surface 184 curving backwardly to the curved edge 182. Each locking lip 180 may be alternatively formed by piercing and deforming the front edge portion 172 so as to form a tab (not shown) having a lower edge, two side edges, and a camming surface sloping backwardly to the lower edge or having a lower point, two side edges, and a camming surface sloping backwardly to the lower point.

Figure 4:
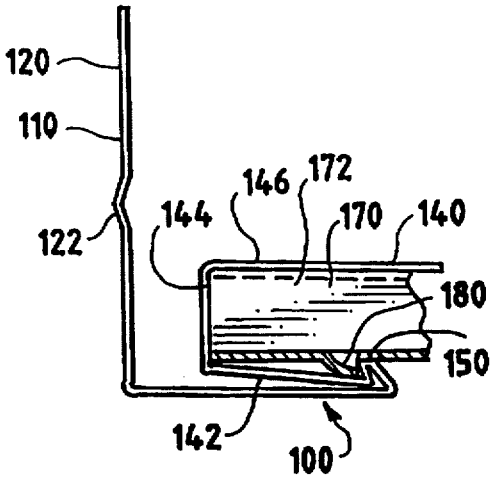
FIG. 4 is a fragmentary detail of the fascia member, the channel member, and the soffit member in an interlocked condition, as seen from one edge of the single piece providing the fascia member and the channel member.

The locking lip 150 of the single piece providing the fascia member 110 and the channel member 140 and the locking lips 180 of the soffit member 170 are shaped complementarily, as shown in FIG. 4, so that the locking lips 180 can be readily cammed past the locking lip 150 with a snap action when the front edge portion 172 of the soffit member 170 is inserted into the channel member 140 but are blocked by the locking lip 150 so as to restrain the front edge portion 172 against being withdrawn from the channel member 140. The material used for the single piece providing the fascia member 110 and the channel member 140 and for the soffit member 170 provides the locking lip 150 and the locking lips 180 with sufficient flexibility to permit the snap action. Alternatively, the front edge portion 172 may be inserted into the channel member 140 by being slid endwise into the channel member 140, through one end of the channel member 140. The reinforcing ribs 176 are adapted to bear against the upper wall 146 of the channel member 140, as shown in FIG. 4, when the locking lips 180 are engaged with the locking lip 150.

Figure 5:
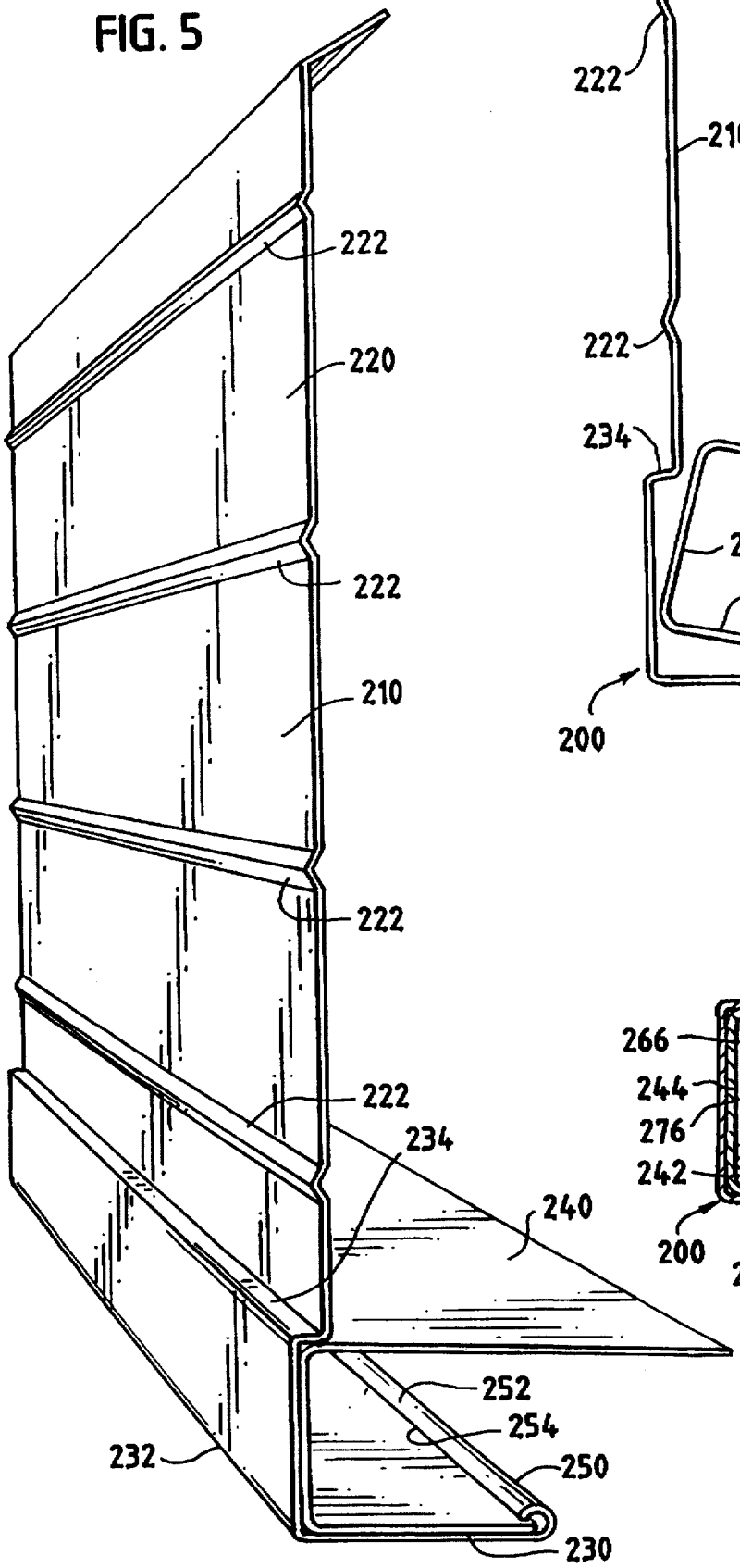
FIG. 5 is a perspective view of a novel combination comprising a fascia member, a channel member, and a soffit member, and according to another contemplated embodiment, in which the fascia member and the channel member are two separate pieces.
Figure 6:
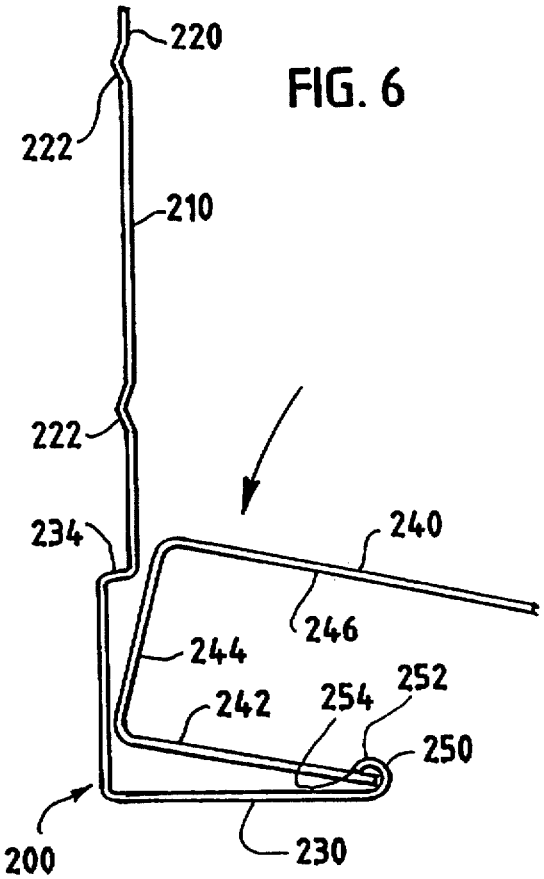
FIG. 6 is a fragmentary view of the channel member being assembled with the fascia member, as seen from one edge of the fascia member and one edge of the channel member.
Figure 7:
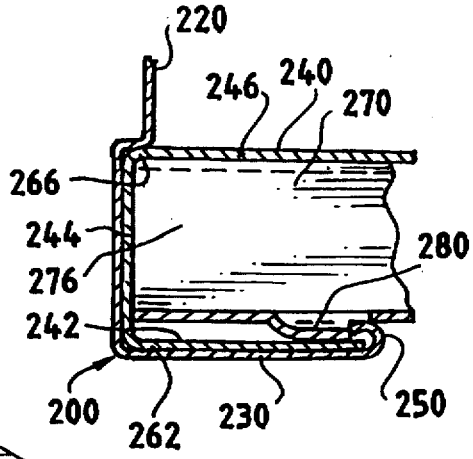
FIG. 7 is a fragmentary view of the fascia member, the channel member, and the soffit member, as assembled and as seen from one edge of the fascia member and one edge of the channel member.

As shown in FIGS. 5, 6, and 7, a novel combination 200 comprising a fascia member 210, a channel member 240, and a soffit member 270 and according to another contemplated embodiment of this invention is useful where the novel combination 100 is useful. The fascia member 210, the channel member 240, and the soffit member 270 are three separate pieces, each of which is elongate, each of which is roll-formed from sheet metal, such as sheet aluminum, and each of which may be pre-painted.

As shown in FIG. 5, the fascia member 210 is roll-formed so as to have a generally vertical panel 220, which has spaced reinforcing ribs 222 extending horizontally and projecting outwardly, so as to have a generally horizontal flange 230 projecting from the generally vertical panel 220 at a lower corner 232, which is defined by a lower edge of the generally vertical panel and by a proximal edge of the generally horizontal flange 230, and so that the generally vertical panel 220 is formed with a step 234 defining a recess 236 between the step 234 and the generally horizontal flange 230. Moreover, the fascia member 210 is roll-formed so as to have a locking lip 250, which extends along a distal edge of the generally horizontal flange 240.

The channel member 240 is roll-formed so as to have a lower wall 242, an inner wall 244, and an upper wall 246. Being generally parallel to each other, the lower wall 242 and the upper wall 246 project from the inner wall 244, approximately at right angles to the inner wall 244, in generally horizontal directions. The inner wall 244 projects upwardly from the lower wall 242, to the upper wall 246, in a generally vertical direction.

The locking lip 250 extending along the generally horizontal flange 230 of the fascia member 210 has a hooked portion 252, which hooks toward the generally vertical panel 220 of the fascia member 210 and which terminates at an edge 254. As shown in FIG. 6, when the fascia member 210 and the channel member 240 are assembled, a distal edge portion 248 of the lower wall 242 is fitted under the edge 254 terminating the hooked portion 252 of the locking lip 250 and the channel member 240 is swung so that the lower wall 242 rests on the generally horizontal flange 230 and so that the recess 236 receives the inner wall 244, a near portion 262 of the lower wall 242, and a near portion 266 of the lower wall 242. Although it is not necessary for the channel member 240 to be adhesively secured to the fascia member 210, the channel member 240 may be adhesively secured thereto, possibly along the lower wall 242 and along the inner wall 244.

The soffit member 270 is similar to the soffit member 170 and is roll-formed so as to be substantially planar and so as to have a series of reinforcing ribs 276, which extend transversely across the soffit member 270 and which are spaced longitudinally from one another along the soffit member 270. The front edge portion 272 of the soffit member 270 is formed with a series of locking lips 280, which are similar to one another and which are spaced longitudinally from one another along the soffit member 270. The locking lips 280 of the soffit member 270 are formed as the locking lips 180 of the soffit member 170 are formed.

The locking lip 250 of the fascia member 210 and the locking lips 280 of the soffit member 270 are shaped complementarily, as shown in FIG. 4, so that the locking lips 280 can be readily cammed past the locking lip 250 with a snap action when the front edge portion 272 of the soffit member 270 is inserted into the channel member 240 but are blocked by the locking lip 250 so as to restrain the front edge portion 272 against being withdrawn from the channel member 240. The material used for the single piece providing the fascia member 210 and the channel member 240 and for the soffit member 270 provides the locking lip 250 and the locking lips 280 with sufficient flexibility to permit the snap action. Alternatively, the front edge portion 272 may be inserted into the channel member 240 by being slid endwise into the channel member 240, through one end of the channel member 240. The reinforcing ribs 276 are adapted to bear against the upper wall 246 of the channel member 240, as shown in FIG. 4, when the locking lips 280 are engaged with the locking lip 250.

Figure 8:
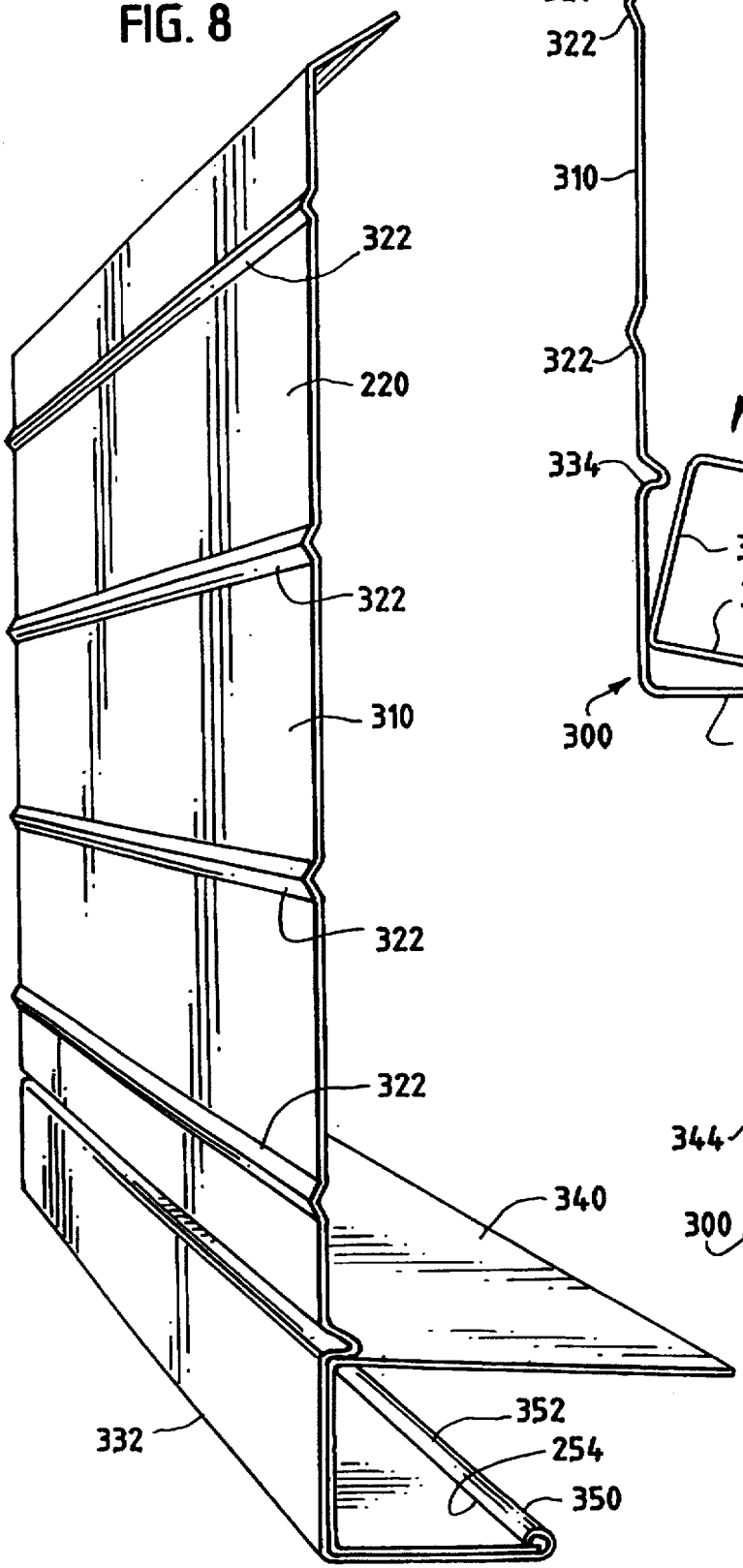
FIG. 8 is a perspective view of a novel combination comprising a fascia member, a channel member, and a soffit member, and according to another contemplated embodiment, in which the fascia member and the channel member are two separate pieces.
Figure 9:
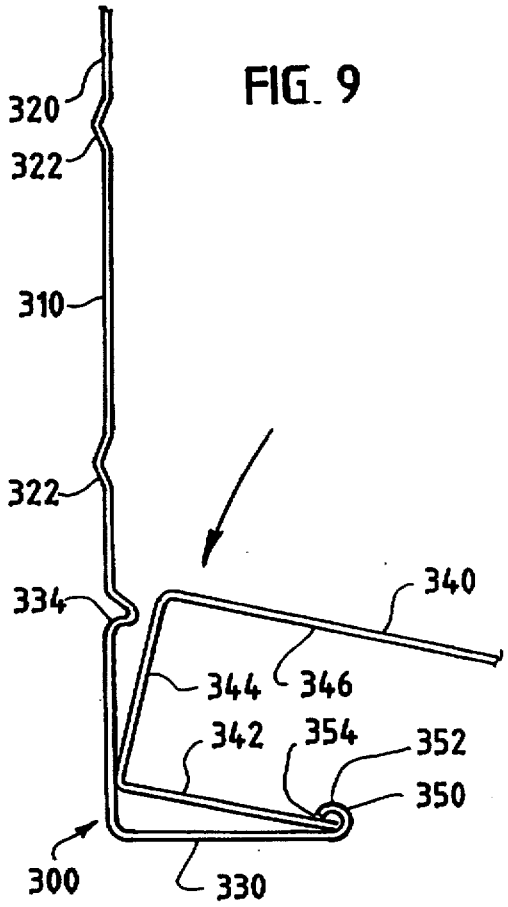
FIG. 9 is a fragmentary view of the channel member being assembled with the fascia member, as seen from one edge of the fascia member and one edge of the channel member.
Figure 10:
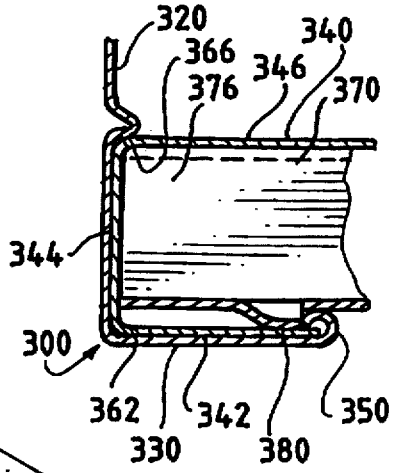
FIG. 10 is a fragmentary view of the fascia member, the channel member, and the soffit member, as assembled and as seen from one edge of the fascia member and one edge of the channel member.

As shown in FIGS. 8, 9, and 10, a novel combination 300 comprising a fascia member 310, a channel member 340, and a soffit member 370 and according to another contemplated embodiment of this invention is useful where the novel combination 100 is useful. The fascia member 310, the channel member 340, and the soffit member 370 are three separate pieces, each of which is elongate, each of which is roll-formed from sheet metal, such as sheet aluminum, and each of which may be pre-painted.

As shown in FIG. 5, the fascia member 310 is roll-formed so as to have a generally vertical panel 320, which has spaced reinforcing ribs 322 extending horizontally and projecting outwardly, so as to have a generally horizontal flange 330 projecting from the generally vertical panel 320 at a lower corner 332, which is defined by a lower edge of the generally vertical panel and by a proximal edge of the generally horizontal flange 330, and so that the generally vertical panel 320 is formed with a reinforcing and restraining rib 334 extending horizontally and projecting inwardly and defining a recess 336 between the step 334 and the generally horizontal flange 330. Moreover, the fascia member 310 is roll-formed so as to have a locking lip 350, which extends along a distal edge of the generally horizontal flange 330.

The channel member 340 is roll-formed so as to have a lower wall 342, an 20 inner wall 344, and an upper wall 346. Being generally parallel to each other, the lower wall 342 and the upper wall 346 project from the inner wall 344, approximately at right angles to the inner wall 344, in generally horizontal directions. The inner wall 344 projects upwardly from the lower wall 342, to the upper wall 346, in a generally vertical direction.

The locking lip 350 extending along the generally horizontal flange 330 of the fascia member 310 has a hooked portion 352, which hooks toward the generally vertical panel 320 of the fascia member 310 and which terminates at an edge 354. As shown in FIG. 6, when the fascia member 310 and the channel member 340 are assembled, a distal edge portion 348 of the lower wall 342 is fitted under the edge 354 terminating the hooked portion 352 of the locking lip 350 and the channel member 340 is swung so that the lower wall 342 rests on the generally horizontal flange 330 and so that the recess 336 receives the inner wall 344, a near portion 362 of the lower wall 342, and a near portion 366 of the lower wall 342. Although it is not necessary for the channel member 340 to be adhesively secured to the fascia member 310, the channel member 340 may be adhesively secured thereto, possibly along the lower wall 342 and along the inner wall 344.

The soffit member 370 is similar to the soffit member 170 and is roll-formed so as to be substantially planar and so as to have a series of reinforcing ribs 376, which extend transversely across the soffit member 370 and which are spaced longitudinally from one another along the soffit member 370. The front edge portion 372 of the soffit member 370 is formed with a series of locking lips 380, which are similar to one another and which are spaced longitudinally from one another along the soffit member 370. The locking lips 380 of the soffit member 370 are formed as the locking lips 180 of the soffit member 170 are formed.

The locking lip 350 of the fascia member 310 and the locking lips 380 of the soffit member 370 are shaped complementarily, as shown in FIG. 4, so that the locking lips 380 can be readily cammed past the locking lip 350 with a snap action when the front edge portion 372 of the soffit member 370 is inserted into the channel member 340 but are blocked by the locking lip 350 so as to restrain the front edge portion 372 against being withdrawn from the channel member 340. The material used for the single piece providing the fascia member 310 and the channel member 340 and for the soffit member 370 provides the locking lip 350 and the locking lips 380 with sufficient flexibility to permit the snap action. Alternatively, the front edge portion 372 may be inserted into the channel member 340 by being slid endwise into the channel member 340, through one end of the channel member 340. The reinforcing ribs 376 are adapted to bear against the upper wall 346 of the channel member 340, as shown in FIG. 4, when the locking lips 380 are engaged with the locking lip 350.

Various modifications may be made in any of the illustrated and described embodiments without departing from the scope and spirit of this invention.

I claim:

1. For trimming a building structure, a combination comprising a fascia member and a soffit member, the fascia member being elongate and having a generally vertical panel and a generally horizontal flange projecting from the generally vertical panel at a lower corner defined by a lower edge of the generally vertical panel and by a proximal edge of the generally horizontal flange, the generally horizontal flange having a distal edge and having a locking lip extending along the distal edge, the soffit member being elongate and having an edge portion having a locking lip engagable with the locking lip extending therealong, the combination further comprising a channel member extending along the generally horizontal flange of the fascia member and confining the edge portion of the soffit member within the channel member, when the locking lip of the edge portion of the soffit member is engaged with the locking lip extending therealong, so as to interlock the fascia member and the soffit member.

2. The combination of claim 1 wherein the fascia member and the channel member are a single piece.

3. The combination of claim 2 wherein the channel member has a lower wall projecting toward the generally vertical panel of the fascia member, from the locking lip extending along the distal edge of the generally horizontal flange, an inner wall projecting upwardly from the lower wall of the channel member, and an upper wall projecting from the inner wall of the channel member, away from the generally vertical panel of the fascia member, in a generally horizontal direction.

4. The combination of claim 3 wherein the soffit member has reinforcing ribs bearing against the upper wall of the channel member when the locking lip of the edge portion of the soffit member is engaged with the locking lip extending along the distal edge of the generally horizontal flange.

5. The combination of claim 4 wherein the edge portion of the soffit member has a plurality of said locking lips spaced from one another and engagable with the locking lip extending along the distal edge of the generally horizontal flange.

* * * * *